US006821584B2

(12) United States Patent
Tashiro et al.

(10) Patent No.: US 6,821,584 B2
(45) Date of Patent: Nov. 23, 2004

(54) INK-JET RECORDING MEDIUM

(75) Inventors: Kouji Tashiro, Hachioji (JP); Toyoki Nishijima, Hachioji (JP); Shinichi Suzuki, Hachioji (JP); Kunimasa Hiyama, Hachioji (JP); Junji Ito, Hino (JP)

(73) Assignee: Konica Corporation, Tokyo (JP)

( * ) Notice: Subject to any disclaimer, the term of this patent is extended or adjusted under 35 U.S.C. 154(b) by 9 days.

(21) Appl. No.: 10/441,472

(22) Filed: May 20, 2003

(65) Prior Publication Data

US 2003/0228427 A1 Dec. 11, 2003

(30) Foreign Application Priority Data

May 28, 2002 (JP) ..... 2002-153906
May 28, 2002 (JP) ..... 2002-153907

(51) Int. Cl.[7] ..... B41M 5/40

(52) U.S. Cl. ..... 428/32.24; 428/32.27; 428/32.28; 428/32.3; 428/32.31; 428/32.38

(58) Field of Search ..... 428/32.24, 32.27, 428/32.28, 32.3, 32.31, 32.38

(56) References Cited

U.S. PATENT DOCUMENTS

| | | | | | |
|---|---|---|---|---|---|
| 6,037,050 | A | * | 3/2000 | Saito et al. | 428/32.26 |
| 6,177,181 | B1 | * | 1/2001 | Hamada et al. | 428/304.4 |
| 6,217,166 | B1 | * | 4/2001 | Saito et al. | 347/100 |
| 6,387,473 | B1 | * | 5/2002 | Sismondi et al. | 428/32.34 |
| 6,620,470 | B2 | * | 9/2003 | Nojima et al. | 428/32.34 |
| 2002/0045032 | A1 | * | 4/2002 | Endo | 428/195 |

* cited by examiner

*Primary Examiner*—B. Shewareged
(74) *Attorney, Agent, or Firm*—Squire, Sanders & Dempsey

(57) ABSTRACT

An ink-jet recording sheet comprising a support having thereon in the following order: (i) a first ink absorbing layer comprising gelatin and a first cationic polymer; and (ii) a second ink absorbing layer comprising gelatin and a second cationic polymer, wherein the first cationic polymer has a larger ink absorption ratio $A_i$ than the second cationic polymer, the ink absorption ratio $A_i$ being defined by the following equation: $A_i$ (%)=((an optical density of a print after immersion in water)/(an optical density of a print before immersion in water))×100.

16 Claims, No Drawings

INK-JET RECORDING MEDIUM

TECHNICAL FIELD

The present invention relates to an ink-jet recording medium and in more detail to a swelling type ink-jet recordings medium which exhibits excellent ink fixability against water, ink absorbability, glossiness, and discoloration resistance.

BACKGROUND

Ink-jet recording is a quiet recording method, and is capable of achieving high speed printing as well as easily achieving multicolor recording by utilizing a plurality of nozzles. As a result, in recent years, ink-jet recording has increasingly been applied to image information output apparatuses used for computers. Further, in its application fields, employed as recording media are transparent film and glossy resin coated paper, and the output images are expanding into texts, drawings, color block copies requiring image quality approaching conventional photography, and various design images.

From the aspect of safety and recording characteristics, mainly employed as ink for ink-jet recording is aqueous ink comprised of water and water-soluble organic solvents as main components, whereby it is intended to minimize clogging of the ink as well as to enhance ink ejection characteristics. Further, conventionally employed as ink-jet recording media (hereinafter also referred to simply as recording media) have been plain paper sheets and recording sheets, called ink-jet recording paper, which comprise a support having thereon a porous ink absorptive layer.

However, since such conventional recording media result in marked ink bleeding and exhibit low glossiness, they are not capable of meeting the demand for higher image quality in recent years. Further, when a conventional porous ink absorptive layer is applied onto transparent film or glossy resin coated paper, problems occur in which transparency or glossiness is degraded due to low light transmission of the porous ink absorptive layer. Further, when the ink absorptive layer is not porous, light transmission increases. However, problems occur in which after printing of the images, ink remains on the surface of the recording medium for an extended period of time due to low ink adsorption whereby drying and fixing time increases.

In order to overcome such problems, it is proposed that gelatin be employed to prepare an ink absorbing layer which exhibits high light transmission as well as excellent aqueous ink adsorption. For example, Japanese Patent Application Open to Public Inspection No. 62-263084 proposes a receiving layer which is prepared employing an aqueous gelatin solution having a specified pH, Japanese Patent Application Open to Public Inspection No. 1-146784 proposes the use of a mixture consisting of gelatin and surfactants, and Japanese Patent Application Open to Public Inspection No. 6-64306 proposes a recording sheet which is prepared in such a manner that after coated gelatin is temporality modified into a gel state, the resulting gel is dried employing a freeze dry method.

Such receiving layers employing gelatin certainly exhibit excellent ink adsorption as well as high light transmission. However, ink drying and fixing take from several minutes to several tens of minutes. When printed images are touched or come into contact with other paper sheets soon after printing, problems occur in which these are stained with ink or the images themselves are degraded.

Generally, ink absorbability of the recording media employing gelatin in the ink absorbing layer depends markedly on the characteristics of polymers employed in the ink absorbing layer. Known as a polymer which has been employed as a polymer exhibiting high ink absorbability is polyvinyl alcohol. However, the use of polyvinyl alcohol causes problems in which ink fixability (water resistance) is degraded. On the other hand, ink fixability is improved by employing cationic water-soluble polymers. However, the use of the cationic water-soluble polymers results in a decrease in glossiness. Currently, a means remains to be found to simultaneously achieve compatibility of excellent ink fixability and high glossiness.

On the other hand, ink-jet recording images result in problems in which discoloration tends to occur due to harmful gases. Specifically, water-soluble phthalocyanine based dyes, which are employed in common jet printers, tend to cause such discoloration. Discoloration mechanism is not yet fully understood. However, it is assumed that a minute amount of active harmful gasses such as ozone, oxidants, $So_x$ and $NO_x$ in ambient air decompose these dyes.

SUMMARY

In order to overcome the aforesaid problems, the present invention was achieved. An object of the present invention is to provide a swelling type ink-jet recording medium which exhibits excellent water resistance of a printed image, ink absorbability, glossiness, and discoloration resistance.

The object of the present invention is achieved employing the embodiments described below.

One structure of the present invention is an ink-jet recording sheet comprising a support having thereon in the following order:

(i) a first ink absorbing layer comprising gelatin and a first cationic polymer; and (ii) a second ink absorbing layer comprising gelatin and a second cationic polymer, wherein the first cationic polymer has a larger ink adsorption ratio $A_i$ than the second cationic polymer, the ink adsorption ratio $A_i$ being defined by the following equation:

$$A_i(\%)=((\text{an optical density of a print after immersion in water})/(\text{an optical density of a print before immersion in water}))\times 100.$$

Another structure of the present invention is an ink-jet recording sheet comprising a support having at least two ink absorbing layers thereon, wherein at least one of the two ink absorbing layers comprises gelatin and a polyvinyl alcohol; the ink absorbing layers comprise the polyvinyl alcohol having a saponification degree of not more than 92% and a weight-average molecular weight of not less than 2000 in an amount of not less than 10 weight % based on the total weight of the polyvinyl alcohol in all of the ink absorbing layers; the outermost ink absorbing layer has a largest weight content ratio of the polyvinyl alcohol among all of the ink absorbing layers; and the outermost ink absorbing layer comprises the polyvinyl alcohol having a saponification degree of not more than 92% and a weight-average molecular weight of not less than 2000.

DESCRIPTION OF THE PREFERRED EMBODIMENT

The present invention will now be detailed.

One of the embodiments of the present invention is characterized in that in an ink-jet recording medium which has a support having thereon ink absorbing layers, at least one of the aforesaid ink absorbing layers comprises gelatin, a cationic polymer, and a cellulose derivative.

In ink-jet recording media, by employing cationic polymers, the fixability of coloring materials is enhanced. However, problems occur in which ink absorbability decreases. On the other hand, by employing cellulose derivativees, ink absorbability is enhanced. However, problems occur the fixability of coloring materials is degraded. By employing the cationic polymers and those derived from the cellulose derivative which exhibit incompatible characteristics with each other, it is possible to achieve some compatibility between fixability of the coloring materials and ink absorbability. However, in the pursuit of quality to equal silver halide photography, the resulting quality has been unsatisfactory. In addition, it was found that new problems occurred in which the resulting glossiness was degraded. The inventors of the present invention performed diligent investigations to overcome the aforesaid problems. As a result, it was discovered that compatibility between fixability of the coloring materials and ink absorbability was satisfied, and in addition, it was possible to enhance glossiness.

In another embodiment of the present invention according, it is preferable that in recording media comprising gelatin, cationic polymers, and the cellulose derivative, employed as the cellulose derivative are cellulose derivatives having a carboxylic acid group.

Polymers such as gelatin, which comprise carboxylic acid, exhibit good absorbability of water incorporated in ink. On the other hand, cationic polymers are useful for fixing coloring materials. When both were employed together, it was found that both ink absorbability and fixability of coloring materials were degraded. In order to try to overcome that problem, diligent investigations were performed. As a result, it was discovered that use of the cellulose derivative, having a carboxylic acid group, was markedly effective to improve ink absorbability and fixability of coloring materials.

Another embodiment of the present invention is characterized in that in an ink-jet recording medium which comprises a support having thereon an ink absorbing layer comprising gelatin, at least two cationic polymers which differ in ink adsorption ratio, defined as above, are provided. Further, another embodiment of the present invention is characterized in that at least two cationic polymers which differ in ink adsorption ratio, defined above, are incorporated and the ink adsorption ratio of the cationic polymer comprised in Ink absorbing layer A nearer to the support is larger than that of the cationic polymer comprised in Ink absorbing layer B farther from the support with respect to said Ink absorbing layer A. Still further, another embodiment of the present is characterized in that at least one of ink absorbing layers comprises at least two types of cationic polymers which differ in ink adsorption ratio defined above. Still further, in another embodiment of the present invention, it is preferable that in the aforesaid constitution, at least one of the ink absorbing layers comprises a cellulose derivative. Still further, in another embodiment of the invention, it is preferable that the ink absorbing layer in the lower layer portion, which comprises cationic polymers having a larger ink adsorption ratio than other upper ink layer, comprises a polyvinyl alcohol together with a cellulose derivative.

Generally, images formed by employing water-soluble dyes exhibit characteristics in which discoloration tends to occur due to effects of oxidizing gases as well as cationic polymers. Specifically, when printed images are black or natural gray, discoloration is readily noticed due to degradation of color balance. The inventors of the present invention performed various investigations in regard to these characteristics and added amount of employed cationic polymers. As a result, it was discovered that the aforesaid problems were overcome employing the constitution specified by the present invention, preferably employing the constitution in which high water resistant cationic polymers were allowed to be present in a still lower layer. In addition, it was discovered that the effects of the present invention was more enhanced by employing a polyvinyl alcohol in combination.

The embodiments of the present invention will now be detailed.

The invention is characterized in that in an ink-jet recording medium which comprises a support having thereon an ink absorbing layer, the aforesaid ink absorbing layer comprises at least one of polyvinyl alcohols, gelatin and a cationic polymer and the pH of the uppermost layer surface is at most 4.0. The layer surface pH is preferably from 3.0 to 4.0, and is preferably from 3.7 to 4.0.

It is not preferable that the pH of the uppermost layer surface exceeds 4.0, because the transparency of the ink absorbing layer decreases. It is also not preferable that it is less than 3.0, because the resulting ink absorbability decreases.

In the present invention, methods which adjust the layer surface pH to the desired value are not particularly limited. When the layer surface pH is decreased, it is possible to use acids such as citric acid, oxalic acid, hydrochloric acid, sulfuric acid, nitric acid, acetic acid, and carbonic acid. On the other hand, when the layer surface pH is to be increased, it is possible to use alkali agents such as sodium hydroxide, potassium hydroxide, sodium carbonate, sodium hydrogencarbonate, and sodium acetate. Further, as another useful means, by previously adding a pH buffer which functions as an acid, it is possible to retard an increase in the layer surface pH after printing even though an ink having a relatively high pH is absorbed.

Preferred as pH buffering agents are weak acids which include, for example, boric acid, carbonic acid, and various types of organic acids. Of these, carbonic acid is not appropriate because it results in various problems during preparation of coating compositions and coating due to the high tendency of generated carbon dioxide gas in the lower pH range. Preferred as weak acids are boric acid and organic acids. Listed as organic acids may be, for example, various non-volatile organic acids such as phthalic acid, salicylic acid, benzoic acid, sebacic acid, lauric acid, palmitic acid, ascorbic acid, citric acid, malic acid, lactic acid, succinic acid, oxalic acid, polyacrylic acid, and benzilic acid.

The pH of the ink absorbing layer surface, as described herein, refers to the value measured employing the method specified in J. TAPPI Paper Pulp Test Method No. 49–86. It is also possible to measure the pH as described below. Approximately 50 $\mu$l of pure water at a pH of 6.2 to 7.3 is dripped on the ink absorbing layer surface and the resulting pH is measured while a flat electrode comes into contact with the resulting water drop.

Each of the components of the ink absorbing layer will now be described.

The ink-jet recording medium of the present invention is characterized in that the ink absorbing layer comprises at least gelatin and a polyvinyl alcohol as water-soluble polymers.

Employed as gelatin may be any gelatin which is prepared employing animal collagen as a raw material. However, preferred is gelatin which is prepared employing collagen which is prepared employing pig skin, cattle hides and bones as raw materials. Further, the types of gelatin are not particularly limited. Lime treated gelatin, acid process gelatin and gelatin derivatives (such as gelatin derivatives described, for example, in Japanese Patent Publication Nos. 38-4854, 39-5514, 40-12237, and 42-26345; U.S. Pat. Nos. 2,525,753, 2,594,293, 2,614,928, 2,763,639, 3,118,766, 3,132,945, 3,186,846, and 3,312,553; and British Patent Nos. 861,414 and 103,189) may be employed individually or in combination.

Gelatin derivatives, as described in the present invention, refer to gelatin in which its amino group, imino group or carboxyl group is subjected to substitution. In the present invention, preferred is gelatin in which its amino or imino group is subjected to substitution, and more preferred is gelatin in which only its amino group is subjected to substitution. Listed as examples of these are phenylcarbamoyl gelatin and phthalated gelatin.

In the present invention, described as gelatin derivatives which are prepared by carrying out substitution of its amino group are, for example, those in U.S. Pat. Nos. 2,691,582, 2,614,928, and 2,525,753.

In the present invention, useful substituents which are employed to prepare gelatin derivatives by substituting its amino group include:

a: acyl groups such as an alkylacyl group, an acetyl group, and a substituted or unsubstituted benzoyl group,
b: sulfonyl groups such as an alkylsulfonyl group and an arylsulfonyl group,
c: carbamoyl groups such as an alkylcarbamoyl group and an arylcarbamoyl group,
d: thiocarbamoyl groups such as an alkylthiocarbamoyl group and an arylthiocarbamoyl group,
e: straight-chain or branched-chain alkyl groups having from 1 to 18 carbon atoms and
f: aromatic heterocyclic aryl groups such as a substituted or unsubstituted phenyl, naphthyl, pyridyl, and furyl group.

Of these, in the present invention, gelatin derivatives are preferred in which the amino group is substituted with an acyl group (—$COR^1$) or a carbamoyl group (—$CONR^1R^2$).

$R^1$ of the aforesaid acyl group or carbamoyl group is a substituted or unsubstituted aliphatic group (for example, an alkyl group having from 1 to 18 carbon atoms and an allyl group), an aryl group, or an aralkyl (for example, a phenethyl group), and $R^2$ is a hydrogen atom, an aliphatic group, an aryl group, or an aralkyl group.

In the present invention, particularly preferred gelatin derivatives are those in which $R^1$ is an aryl group and $R^2$ is a hydrogen atom.

Examples of substituents which substitute the amino group of gelatin derivatives are shown below.

(A-1)

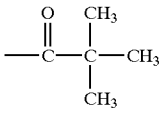

-continued (A-2)

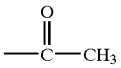

(A-3)

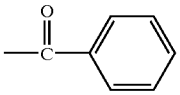

(A-4)

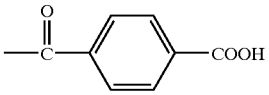

(A-5)

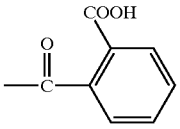

(A-6)

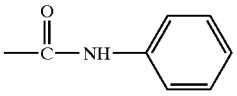

(A-7)

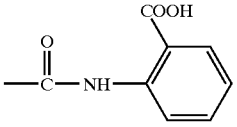

(A-8)

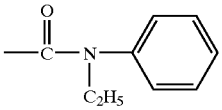

(A-9)

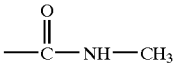

In order to allow the ink absorbing layer to quickly absorb ink, in the present invention, it is preferable to use gelatin derivatives which are previously substituted with a substituent capable of reacting with an amino group or an imino group under the substitution ratio of at least 60 percent of the total amount of either the aforesaid amino or imino group. Gelatin derivatives are particularly preferred in which at least 80 percent of the total amount of amino group is substituted.

Further, the jelly strength (measured by the frame type jelly strength meter according to the PAGI method) of gelatin according to the present invention is customarily at least 150 g, and is preferably from 200 to 300 g.

Cationic polymers will now be described.

Initially, the absorption ratio of the cationic polymers, as described in the present invention, will be described.

The absorption ratio of catinonic polymers, as described in the present invention, is defined as follows. As noted above, printing is carried out employing black dye ink onto an ink-jet recording medium comprising cationic polymers to result in a density of 1.0 (0.95 to 1.04). The resulting print is immersed in pure water at 30° C. for 10 seconds and subsequently dried. Thereafter, density prior to and after the immersion is measured and the ink adsorption ratio $A_i$ is obtained based on Formula (I) described below. The resulting value is defined as the ink adsorption ratio of these cationic polymers.

Formula (I)

Ink adsorption ratio $Ai$(percent)=ink density after immersion in pure water/ink density prior to immersion in pure water×100

Preparation of Recording Medium

A recording medium is prepared as described below. An ink absorbing layer, which is comprised of 5.0 g/m$^2$ of lime treated gelatin, 0.5 g/m$^2$ of measured cationic polymers and an optimal amount of surfactants, is formed on a support which has been prepared by covering a paper support with polyethylene on both sides.

Measurement of Ink adsorption Ratio

Printing is carried out employing black ink to obtain a density of 1.0 (0.95 to 10.4). The black ink employed has the following compositions:

| | |
|---|---|
| C. I. Food Black 2 | 4 weight parts |
| Diethylene glycol | 25 weight parts |
| Sodium dioctylsulfo succinate | 0.01 weight parts |
| Water | 70.99 weight parts |

After the prepared print is allowed to stand for 10 minutes under an ambience of 23° C. and 50 percent relative humidity, it is immersed in pure water at 30° C. for 10 seconds and subsequently dried. Thereafter, density prior to and after immersion is noted and the ink adsorption ratio is obtained based on aforesaid Formula (I).

In the present invention, the ink adsorption ratio of each cationic polymer, which will be described, is measured employing the aforesaid method, and cationic polymers are selected based on the obtained value and may be employed in combination.

In the present invention, the ink adsorption ratio of the cationic polymer employed in Ink absorbing layer A, near the support, is preferably at least 85 percent, is more preferably from 90 to 100 percent, and is still more preferably from 95 to 100 percent. Further, the ink adsorption ratio of a cationic polymer incorporated in Ink absorbing layer B which is farther from the support than Ink absorbing layer A is preferably from 50 to 85 percent, is more preferably from 60 to 85 percent, and is most preferably from 70 to 85 percent.

Cationic polymers will now be described.

The cationic polymers, as described in the present invention, refer to those in which the main polymer component is cationic in its aqueous solution. Listed as typical cationic polymers are polymers comprising a primary, secondary or tertiary amino group, or a quaternary ammonium salt, described in Japanese Patent Application Open to Public Inspection Nos. 61-61887, 61-63477, 5-104848, and 5-124329. Any of the such water-soluble cationic polymers may be employed and the types are not particularly limited. However, examples of cationic polymers preferably employed in the present invention include as follows.

a) polyallylamines
b) dicyandiamide based condensation products
c) polyethylene imines
d) cation-modified PVA
e) cation-modified PVP
f) epichlorohydrin derivatives
g) amino group substituted nylon
h) polymers comprising constitution units derived from monomer units represented by Formula (1) described below
i) polymers comprising constitution units derived from monomer units represented by Formula (2) described below
j) polymers comprising constitution units derived from monomer units represented by Formula (3) described below Formula (1)

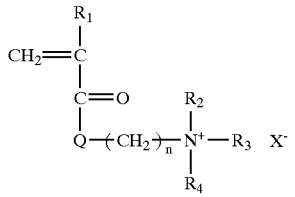

Formula (2)

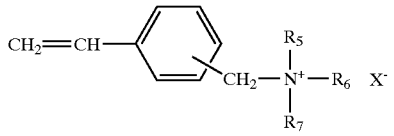

Formula (3)

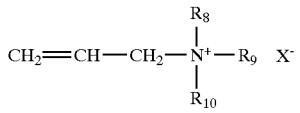

In Formula (1), $R^1$ represents a hydrogen atom or a substituted or unsubstituted alkyl group; Q represents an oxygen atom or —NH—; $R^2$, $R^3$, and $R^4$ each represents a substituted or unsubstituted lower alkyl group, which may be the same or different; $X^-$ represents a halogen ion, a sulfonic acid anion, an alkylsulfonic acid anion, an acetic acid anion, or an alkylcarboxylic acid anion; n represents 2 or 3.

In Formula (2), $R^5$, $R^6$, and $R^7$ each represents a substituted or unsubstituted lower alkyl group, which may be the same or different; $X^-$ represents a halogen ion, a sulfonic acid anion, an alkylsulfonic acid anion, an acetic acid anion, or an alkylcarboxylic acid anion; and n represents 2 or 3.

In Formula (3), $R^8$, $R^9$, and $R^{10}$ each represents a substituted or unsubstituted lower alkyl group, which may be the same or different; $X^-$ represents a halogen ion, a sulfonic acid anion, an alkylsulfonic acid anion, an acetic acid anion, or an alkylcarboxylic acid anion; and n represents 2 or 3.

The lower alkyl group represented by $R^1$ through $R^{10}$ is preferably either a methyl group or an ethyl group.

Polyallylamines, as described in the present invention, refer to polyallylamine represented by Formula (4), described below, polydiallylamine represented by Formula (5-1) or (5-2), also described below, and polydiallylamine derivatives represented by Formula (6-1) or (6-2), described below, or copolymers thereof.

Formula (4)

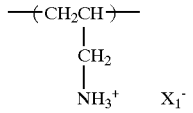

In Formula (4), n represents an integer of 5 to 10,000 and $X_1^-$ represents a residual group of inorganic or organic acids.

Formula (5-1)

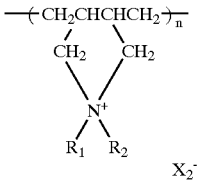

Formula (5-2)

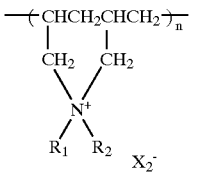

Formula (6-1)

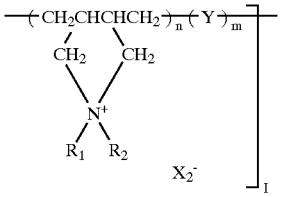

Formula (6-2)

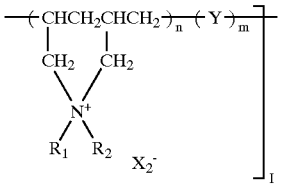

In Formulas (5-1), (5-2), (6-1), and (6-2), $R_1$ and $R_2$ each represents a hydrogen atom, a methyl group, an ethyl group, or a hydroxyethyl group, $X_2^-$ represents a residual group of inorganic or organic acids, Y represent a divalent linking group, n/m is from 9/1 to 2/8, and 1 is from 5 to 10,000.

Listed as specific examples of polydiallylamine derivatives represented by Formula (6-1) or (6-2) are those comprising the $SO_2$ group represented by Formula described in Japanese Patent Application Open to Public Inspection No. 60-83882 as a repeating unit, copolymers with acrylamide described on page 2 of Japanese Patent Application Open to Public Inspection No. 1-9776, and copolymers with polydiallylamine represented by Formula (6-1) or (6-2) of the present invention.

Listed as specific examples of dicyandiamide based condensation products employed in the present invention are dicyandiamidoformalin condensation products and polyalkylene polyaminedicyandiamide ammonium salt condensation products. These are commercially available under such trade names as Sunfix 70 of Sanyo Kasei Co., Nikaflock D-1000 of Nihon Carbide Co., Neofix F and Neofix RP-70Y of Nikka Kagaku Co.

Ethyleneimines, as described in the present invention, refer to polymers prepared by polymerizing ethyleneimine and derivatives thereof. Of these, polyethyleneimine quaternary ammonium compounds are specifically preferred. Listed as specific examples are those described in Japanese Patent Application Open to Public Inspection Nos. 60-72785 and 60-76386.

Cation-modified polyvinylpyrrolidones, as described in the present invention, refer to copolymers of polyvinylpyrrolidone with monomer units having a cationic group. Listed as specific examples of monomer units having a cationic group are quaternarized dialkylaminoethyl methacrylate and methacrylamidopropyltrialkylammonium salt.

Listed as specific examples of epichlorohydrin derivatives employed in the present invention are polyamide-epichlorohydrin resins, reaction products of epichlorohydrin with tertiary amine, described on page 2 of Japanese Patent Application Open to Public Inspection No. 61-252189, and compounds represented by Formula (II), described on page 4 of Japanese Patent Application Open to Public Inspection No. 62-259882.

It is possible to synthesize these compounds employing methods known in the art. Further, they are commercially available under such trade names as Narupoly 607 (manufactured by Naruko Chemical Co.) and Polyfix 601 (manufactured by Showa Kobunshi Co.).

Specific examples of amino group substituted nylon are described on page 2 of Japanese Patent Application Open to Public Inspection No. 59-33179. They are commercially available under such the trade name as AQ Nylon (manufactured by Toray Co.).

Employed as cationic polyhydroxylated aluminum usable in the present invention may be those described in Item 2 of Japanese Patent Application Open to Public Inspection No. 60-257286.

Listed as preferable compounds of monomers represented by Formula (1) may be, for example, methyl chloride, ethyl chloride, methyl bromide, ethyl bromide, methyl iodide, quaternary compounds prepared by ethyl iodide, or sulfonates alkylsulfonates, acetates or alkylcarboxylates which are subjected to anion substitution of N,N-dimethylaminoethyl (meth)acrylate, N,N-diethylaminoethyl (meth)acrylate, N,N-dimethylaminopropyl (meth)acrylate, N,N-dimethylaminopropyl (meth)acrylate, N,N-dimethylaminoethyl (meth)acrylamide, N,N-diethylaminoethyl (meth)acrylamide, N,N-dimethylaminopropyl (meth)acrlylamide, and N,N-diethylaminopropyl (meth)acrylamide. Of these, listed as specifically preferable compounds may be, for example, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(mathacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylaminopropylammonium chloride, triethyl-3-(methacryloylamino)propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy) ethylammonium chloride, N,N-dimethyl-N-ethyl-3-(acryloylamino)propylammonium chloride, trimethyl-2-(methacryloyloxy)ethyl ammonium bromide, trimethyl-3-(acryloylamino)propylammonium bromide, trimethyl-2-(methacryloyloxy)ethylammonium sulfonate, and trimethyl-3-(acryloylamino)propylammonium acetate.

Listed as preferable examples of monomers represented by Formula (2) may be trimethyl-p-vinylbenzylammonium chloride, trimethyl-m-vinylbenzylammonium chloride, trimethyl-p-vinylbenzylammonium chloride, trimethyl-m-vinylbenzylammonium chloride, N,N-dimethyl-N-ethyl-p-vinylbenzylammonium chloride, N,N-diethyl-N-methyl-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, and trimethyl-m-vinylbenzylammonium acetate.

Listed as preferable examples of the monomers represented by Formula (3) may be diallyldimethylammonium chloride, diallyldiethylammonium chloride, diallyldimethylammonium bromide, diallyldimethylammonium sulfonate, and diallyidimethylammonium acetate.

By allowing these monomer units to further copolymerize with monomers selected from acrylamide, methacrylamide, N,N-dimethylacrylamide, N-isopropylacrylamide, diacetoneacrylamide, N-methylolacrylamide, 2-hydroxyethyl (meth)acrylate, 2-hydroxypropyl (meth) acrylate, and N-vinylpyrrolidone in the range of 20 to 80 parts by weight, it is possible to increase the ink adsorption capacity as well as the ink adsorption rate of the polymer itself having the aforesaid quaternary ammonium salt group. Further, it is possible to provide markedly preferable properties such as adjustment of ink dot diameter to the optimal size and minimization of printing unevenness of the solid image portion.

In the present invention, the added amount of the aforesaid cationic polymers is not particularly limited. However, in one of the embodiments of the present invention, the content ratio of the cationic polymer (or polymers) in the ink absorbing layer, comprising the aforesaid cationic polymers and the cellulose derivative, is preferably from 1 to 20 percent by weight. When the added amount of the aforesaid cationic polymers is less than one percent by weight, it is impossible to obtain the desired water resistance, while when it exceeds 20 percent by weight, it is not preferable due to degradation of physical properties of the coating or decrease of glossiness.

The cellulose derivative will now be described.

Preferably employed as the cellulose derivative usable in the present invention may be water-soluble cellulose derivatives. In one of the embodiments of the present invention, it is preferable to employ at least one water-soluble cellulose derivative selected from carboxymethyl cellulose (cellulose carboxymethyl ether), methyl cellulose, hydroxyethyl cellulose, and hydroxypropyl cellulose. In one of the embodiments of the present invention, a carboxylic acid group-containing cellulose derivative is preferred, but carboxymethyl cellulose (cellulose carboxymethyl ether) is particularly preferred. Listed as others may be cellulose derivatives such as nitrocellulose, cellulose acetate propionate, cellulose acetate, and cellulose sulfuric acid ester.

In the recording medium of the present invention, the used amount of the aforesaid cellulose derivative is preferably from 15 to 35 percent by weight in terms of solids with respect to the ink absorbing layer. When the aforesaid amount exceeds 35 percent by weight, it is not preferable because physical properties of the layer may be degraded due to a decrease in the degree of layer hardening.

Polyvinyl alcohols will now be described.

A polyvinyl alcohol preferably employed in the present invention include a common polyvinyl alcohol which is prepared by hydrolyzing polyvinyl acetate, and in addition, a modified polyvinyl alcohol such as a polyvinyl alcohol in which the terminal is subjected to cation modification and an anion-modified polyvinyl alcohol having an anionic group.

A polyvinyl alcohol, having an average degree of polymerization of at least 1,000, is preferably employed which is prepared by hydrolyzing polyvinyl acetate. Specifically more preferably employed is a polyvinyl alcohol, having an average degree of polymerization of 1,500 to 5,000. A polyvinyl alcohol, having a saponification ratio of 70 to 100 percent, is preferred and a polyvinyl alcohol, having a saponification ratio of 80 to 99.5 percent, is particularly preferred. However, in one embodiment of the present invention, it is preferable that a polyvinyl alcohol, having a saponification ratio of at most 92 percent and a weight average molecular weight of at least 2,000, is comprised in an amount of at least 10 percent by weight with respect to the total content of polyvinyl alcohols. It is particularly preferred that a polyvinyl alcohol, having a saponification ratio of 80 to 92 percent and a weight-average molecular weight of 2,000 to 5,000, is comprised in an amount of 10 to 50 percent by weight with respect to the total content of polyvinyl alcohols.

It is preferable that by employing a polyvinyl alcohol which exhibits the aforesaid characteristics, high ink absorbability is realized and it is possible to minimize ink transfer-to the rear surface, even though recording media are stacked after printing is carried out on the recording media.

Listed as cation-modified polyvinyl alcohols are, for example, polyvinyl alcohols having a primary, secondary or tertiary amino group, or a quaternary ammonium group in the main chain or side chain of the polyvinyl alcohol, as described in Japanese Patent Application Open to Public Inspection No. 61-10483. Such polyvinyl alcohols may be prepared by saponifying the copolymer of ethylenic unsaturated monomers, having a cationic group with vinyl acetate.

Listed as ethylenic unsaturated monomers, having a cationic group, are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxylethyltrimethylammonium chloride, N,N,N-trimethyl-(3-methacrylamidopropyl)ammonium chloride, and N-(1,1-dimethyl-3-dimethylaminopropyl)acrylamide.

The ratio of cation-modified group containing monomers in the cation-modified polyvinyl alcohol is from 0.1 to 10 mol percent with respect to vinyl acetate, and is preferably from 0.2 to 5 mol percent.

Listed as anion-modified polyvinyl alcohols are, for example, polyvinyl alcohol, having an anionic group, described in Japanese Patent Application Open to Public Inspection No. 1-206088, copolymers of polyvinyl alcohol with vinyl compounds, having a water solubilizing group, as described in Japanese Patent Application Open to Public Inspection Nos. 61-237681 and 63-307979, and modified polyvinyl alcohol, having a water solubilizing group, as described in Japanese Patent Application Open to Public Inspection No. 7-285265.

Further, listed as nonion-modified polyvinyl alcohols are, for example, polyvinyl alcohol derivatives in which a polyalkylene oxide group is added to a part of the polyvinyl alcohol, as described in Japanese Patent Application Open to Public Inspection No. 7-9758, and block copolymers of vinyl compounds, having a hydrophobic group with vinyl alcohol, described in Japanese Patent Application Open to Public Inspection No. 8-25795.

At least two types of polyvinyl alcohols, having different degrees of polymerization, weight average molecular weights, saponification ratios, and modification types, may be employed in combination.

In order to minimize discoloration of ink-jet printing images, it is necessary to utilize methods in which coloring materials are not brought into contact with oxidizing gases such as oxygen. As a result, it is essential that in swellable type recording media, the interior of the ink absorbing layer, which is farthest from ambient air, is dyed with coloring materials. When only this means is employed, it is difficult to achieve discoloration resistance equal to silver salt photographic materials. Accordingly, the inventors of the present invention conducted diligent investigations to overcome the aforesaid drawbacks. As a result, excellent discoloration resistance was achieved, as described below. By allowing polyvinyl alcohol, especially polyvinyl alcohol having a saponification ratio of at most 92 percent, as well as a weight average molecular weight of at least 2,000, to exist near dyed materials, harmful gases, which accelerate discoloration of dyes, are blocked.

In the present invention, other than gelatin, cellulose derivative, and polyvinyl alcohol previously described, it is possible to combine water-soluble polymers known in the art in. Listed as such water-soluble polymers may be, for example, a polyvinylpyrrolidone class, acryl group containing polymers (refer to Japanese Patent Application Open to Public Inspection No. 60-168651) such as polyacrylamide, polydimethylacrylamide, polydimethyl aminoacrylate, and acrylic acid-vinyl alcohol, copolymers, starch, oxidized starch, carboxyl starch, dialdehyde starch, cationic starch, dextrin, gum Arabic, Pullulan, dextran, polyalkylene glycols such as polyethylene glycol, and polypropylene glycol, synthetic polymers (refer to Japanese Patent Application Open to Public Inspection Nos. 61-32787, 61-237680, and 61-277483) such as polyvinyl ether, polyglycerin, maleic acid-alkyl vinyl ether copolymers, maleic acid-N-vinylpyrrole copolymers, styrene-maleic anhydride copolymers, and polyethyleneimine.

In the ink-jet recording medium of the present invention, the proportion of these water-soluble polymers in the ink absorbing layer is preferably from 10 to 70 percent by weight and is more preferably from 20 to 60 percent by weight.

Each of the other constitution components of the recording media, other than the factors previously described, will now be described.

In the present invention, for enhancement of water resistance, the ink absorbing layer may be subjected to action of suitable crosslinking agents. Specific examples of crosslinking agents include aldehyde based compounds such as formaldehyde and glutaraldehyde; ketone compounds such as diacetyl and chloropentanedione; reactive halogen containing compounds such as bis(2-chloroethylurea) and 2-hydroxy-4,6-dichloro-1,3,5-triazoine, as described in U.S. Pat. No. 3,288,775; divinylsulfone; compounds having reactive olefin as described in U.S. Pat. No. 3,635,718; N-methylol compounds described in U.S. Pat. No. 2,732,316; isocyanates as described in U.S. Pat. No. 3,103,437; triazine compounds as described in U.S. Pat. Nos. 3,017,280 and 2,983,611; carbodiimide based compounds as described in U.S. Pat. No. 3,100,704; epoxy compounds as described in U.S. Pat. No. 3,091,537; halogen carboxyaldehydes such as mucochloric acid; and dioxane derivatives such as dihydroxydioxane. These may be employed individually or in combination of at least two types. The added amount of crosslinking agents is preferably from 0.01 to 10 g with respect to 100 g of constituting modified polyvinyl alcohol, and is more preferably from 0.1 to 5 g.

The methods usually employed to form the ink absorbing layer according to the present invention are coating methods such as a size press method, a roll coating method, a blade coating method, an air knife coating method, a gate roll coating method, a rod bar coating method, a curtain coating method, a slide hopper coating method, and an extrusion coating method.

In the present invention, incorporated in the ink absorbing layer may be various types of additives, known in the art, such as surfactants, binders and hardeners, and in addition, inorganic pigments, coloring dyes, coloring pigments, ink dye fixing agents, UV absorbers, antioxidants, pigment dispersing agents, antifoaming agents, leveling agents, antiseptic agents, optical brightening agents, viscosity stabilizing agents, and pH regulators.

In the present invention, for the purpose of enhancing image quality, it is preferable that surfactants are added to the ink absorbing layer so that the ink absorbability is not adversely affected. Employed surfactants may include any of the anion based, cation based, nonion based, or betaine based. Further, low molecular and high molecular weight surfactants as well as different types may be employed in combination. Fluorine based surfactants are more preferred.

In a conventional method for using surfactants, it has been assumed that it is not preferable to employ anionic surfactants together with cationic surfactants due to formation of coagulation in a solution prior to coating. However, the fluorine based surfactants result in no coagulation in a solution state. Further, it was found that when they were employed on ink-jet recording sheets, excellent ink receiving properties were exhibited and phenomena were minimized in which ink droplets diffused over time, whereby it was possible to employ larger droplets to obtain higher density images with less unevenness.

The anionic fluorine based surfactants or cationic fluorine based surfactants employed in the present invention may be synthesized employing methods described, for example, in U.S. Pat. Nos. 2,559, 751, 2,567,011, 2,732,398, 2,764,602, 2,806,866, 2,809,998, 2,915,376, 2,915,528, 2,918,501, 2,934,450, 2,937,098, 2,957,031, 3,472,894, and 3,555,089; British Patent Nos. 1,143,927 and 1,130,822; Japanese Patent Publication No. 45-37304; Japanese Patent Publication Open to Public Inspection Nos. 47-9613, 49-134614, 50-117705, 50-117727, 50-121243, 52-41182, and 51-12392; J. Chem. Soc. page 2789, 1950 and pages 2574 and 2640, 1957; J. Amer. Chem. Soc., Volume 79, page 2549 (1957); J. Japan Oil Chemists Soc., Volume 12, page 653; and J. Org. Chem., Volume 30, page 3524 (1965).

Some of these fluorine based surfactants are commercially available under such trade names as Megafacs F available from Dainippon Ink Kagaku Kogyo Co., Fluorad FC available from Minnesota Mining and Manufacturing Co., Monflor available from Imperial Chemical Industry Co., Zonyls available from EI DuPont de Nemours & Co., and Licowet VPF available from Farwerke Hoechst AG.

The total employed amount of these cationic fluorine based surfactants and anionic fluorine based surfactants is preferably from 0.1 to 1,000 mg per $m^2$, is more preferably from 0.5 to 300 mg, and is still more preferably from 1.0 to 150 mg. When employed in combination, each type of surfactants may be employed in combination of at least two. In addition to these, nonionic fluorine based surfactants, betaine type fluorine based surfactants and hydrocarbon based surfactants may be employed together with the aforesaid fluorine based surfactants.

In the present invention, the adding ratio of anionic fluorine based surfactants to cationic fluorine based surfactants is preferably from 1:10 to 10:1 in terms of mol ratio, and is more preferably from 3:7 to 7:3.

The coated weight of the ink absorbing layer according to the present invention is preferably from 3 to 100 g/$m^2$, and is more preferably from 5 to 50 g/$m^2$.

Further, the ink absorbing layer is to be provided on at least one side of the support. However, in order to minimize curling, the ink absorbing layer may be provided on both sides.

In the present invention, in order to minimize adhesion, it is possible to employ matting agents in the ink absorbing layer(s).

Matting agents, as described herein, refer to those well known in the photographic technology field and can be defined as discontinuous solid particles comprised of inorganic or organic materials, which are capable of being dispersed into hydrophilic organic colloidal binders. Examples of inorganic matting agents include oxides (for example, silicon dioxide, titanium oxide, magnesium oxide, and aluminum oxide), alkaline earth metal salts (such as sulfates and carbonates, specifically barium sulfate, calcium carbonate, magnesium sulfate, and calcium carbonate), non-image forming silver halide grains (being silver chloride and silver bromide, in which iodine atoms in a minute amount may be incorporated as a halogen component), and glass.

Further, examples of organic matting agents include starch, cellulose esters (for example, cellulose acetate propionate), cellulose ethers (for example, ethyl cellulose), and synthetic resins. Synthetic resins include, for example, water-insoluble or sparsely water-soluble synthetic polymers such as alkyl (meth)acrylate, alkoxyalkyl (meth) acrylate, glycidyl (meth)acrylate, (meth)acrylamide, vinyl esters (for example, vinyl acetate), acrylonitrile, olefins (for example, ethylene), styrene, and benzoguanamine-formaldhyde condensation products, which may be employed individually or in combination. Along with these, polymers may be employed in which combinations of acrylic acid, methacrylic acid, α,β-unsaturated dicarboxylic acids, hydroxyalkyl (meth)acrylate, sulfoalkyl (meth) acrylate, styrenesulfonic acid are employed as a monomer component.

In addition to these, employed may be epoxy resins, nylon, polycarbonates, phenol resins, polyvinylcarbazole, and polyvinylidene chloride.

From the viewpoint of transporting properties, it is preferable that the weight average particle diameter of these is from 3 to 20 μm, and the total weight (occasionally referred to as a coverage weight) in the ink absorbing layer is from 10 to 100 mg/m$^2$. From the aspect of stability of coating compositions, it is preferable that particles of at most 3 μm and at least 20 μm are previously removed employing classification procedures.

Supports employed in the present invention may be transparent or opaque depending on the purpose of the use.

Employed as transparent supports may be any of those known in the art, which include, for example, film comprised of polyester resins, cellulose acetate resins, acrylic resins, polycarbonate resins, polyvinyl chloride resins, polyimide resins, cellophane, and celluloid. Of these, from the viewpoint of rigidity and transparency, polyester resins, especially polyethylene terephthalate film, are preferred.

Employed as opaque supports may be non-coated paper such as fine-quality paper, medium-quality paper, super-calendered finish paper, single sided glossy paper, and tracing paper, coated paper such as art paper, coated paper, light-weight coated paper, slightly coated paper, and cast coated paper, films such as plastic film, pigment containing opaque film, and foamed film, resin coated paper, resin impregnated paper, nonwoven fabric, fabric and composites thereof. Of these, from the viewpoint of glossiness as well as smoothness, resin coated paper and various types of films are preferred. Further, from the sense of touch and high quality feel, resin coated paper, polyolefin resin coated paper, and polyester based film are more preferred.

Base paper which constitutes preferably employed resin coated paper is not particularly limited and common paper may be employed. However, smooth base paper such as paper which is employed for photographic supports is preferred. Employed as pulp which constitutes base paper are mixtures of one or more types of natural pulp, regenerated pulp, and synthetic pulp. Additives such as sizing agents, paper strength enhancing agents, fillers, antistatic agents, optical brightening agents, and dyes, which are customarily used in paper making, are incorporated in the aforesaid base paper.

Further, surface sizing agents, paper surface strength enhancing agents, optical brightening agents, antistatic agents, dyes, and anchor agents may be applied onto the surface.

Still further, the thickness of the aforesaid base paper is not particularly limited. However, base paper exhibiting high surface smoothness is preferred. Such surface smoothness is obtainable by pressing base paper by applying pressure to base paper while calendaring during or after the paper making process.

Employed as resins for producing resin coated paper may be polyolefin resins and electron beam cured resins. Polyolefin resins include olefin homopolymers such low density polyethylene, high density polyethylene, polypropylene, polybutene, and polypentene, or copolymers such as ethylene-propylene copolymers which are copolymers comprised of at least two olefins, and mixtures thereof. Polymers having different densities and melt indices may be employed individually or in combination.

Further, it is preferable that various additives are incorporated in resins employed in the resin coated paper while suitably combined. Such additives include white pigments such as titanium oxide, zinc oxide, talc, and calcium carbonate; fatty acid amides such as stearic acid amide and arachidic acid amide; fatty acid metal salts such as zinc stearate, calcium stearate, aluminum stearate, and magnesium stearate; antioxidants such as Irganox 1010 and Irganox 1076; blue pigments and dyes such as cobalt blue, ultramarine, Sicilian blue, and phthalocyanine blue; magenta pigment and dyes such as cobalt violet, fast violet, and manganese violet; optical brightening agents; and UV absorbers.

In the present invention, aqueous ink is preferably employed, and liquid recording compositions, comprising colorants, liquid media, and other additives, are employed. Listed as colorants are water-soluble dyes such as direct dyes, acid dyes, basic dyes, reactive dyes, or food dyes.

Employed as solvents of the aqueous ink are water and various water-soluble organic solvents. Preferred water-soluble organic solvents include alkyl alcohols having from 1 to 4 carbon atoms such as methyl alcohol, ethyl alcohol, propyl alcohol, isopropyl alcohol, butyl alcohol, sec-butyl alcohol, tert-butyl alcohol, and isobutyl alcohol; amides such as dimethyl formamide and dimethyl acetamide; ketones or ketone alcohols such as acetone and diacetone alcohol; ethers such as tetrahydrofuran and dioxane; polyalkylene glycols such as polyethylene glycol and polypropylene glycol; alkylene glycols having 2 to 6 alkylene groups such as ethylene glycol, propylene glycol, butylenes glycol, triethylene glycol, 1,2,6-haxanettiol, thiodiglycol, hexylene glycol, and diethylene glycol; lower alkyl ethers of polyhydric alcohols such as glycerin, ethylene glycol methyl ether, diethylene glycol methyl (or ethyl) ether, triethylene glycol monomethyl ether; pyrrolidinones such as 2H-pyrrolidinone; and pyrrolidones such as 1-methyl-2-pyrrolidone and 2-pyrrolidone. Of many water-soluble organic solvents, preferred are polyhydric alcohols such as diethylene glycol, lower alkyl ethers of polyhydric alcohols such as triethylene glycol monomethyl ether and triethylene glycol monoethyl ether, as well as pyrrolidones.

In the present invention, in order to minimize clogging of ink head nozzles, it is preferable to use mixed solvents consisting of water and organic solvents. In such cases, the mixing weight ratio of water to organic solvents is preferably from 1/9 to 9/1, and is more preferably from 4/6 to 9/1.

Listed as other additives to ink are, for example, pH regulators metal sequestering agents, biocides, viscosity modifiers, surface tension regulating agents, humectants, surfactants, anti-rusting agents.

EXAMPLES

The present invention will now be specifically described with reference to examples. However, the present invention is not limited to these examples.

Example 1

<<Preparation of Recording Media>>

Recording Media 1 through 13 were prepared according to the steps described below.

Preparation of Recording Medium 1

Preparation of Support 1

A 35 $\mu$m thick low density polyethylene with a density of 0.92 was applied onto the reverse surface of a 200 g/m$^2$ basic weight photographic base paper, with a water content of 6 percent, employing an extrusion coating method. Subsequently, a 40 $\mu$m thick low density polyethylene with a density of 0.92, comprising 5.5 percent of anatase type titanium oxide, was applied onto the front surface, employing an extrusion coating method, whereby Support 1 covered with polyethylene on both sides was prepared. The front surface was then subjected to corona discharge and was coated with a sublayer comprised of polyvinyl alcohol at a coating weight of 0.03 g/m$^2$. The reverse surface was also subjected to corona discharge followed by application of a latex layer at a coating weight of 0.12 g/m$^2$.

Preparation of Ink absorbing layer Coating Composition 1

| | |
|---|---|
| Hydroxyethyl cellulose | 100 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 1 was thus prepared.

Coating

The aforesaid Ink absorbing layer Coating Composition 1 was applied onto Support 1 prepared as above at a dried layer weight of 8 g/m$^2$, employing a bar coating method. The coating was temporarily cooled to approximately 7° C., and then dried by 20 to 65° C. blown air, whereby Recording Medium 1 was prepared.

Preparation of Recording Medium 2

Recording Medium 2 was prepared in the same manner as aforesaid Recording medium 1, except that Ink absorbing layer Coating Composition 1 was replaced with Ink absorbing layer Composition 2, described below.

Preparation of Ink absorbing layer Coating Composition 2

| | |
|---|---|
| Lime treated gelatin (KV-3000, manufactured by Konica Gelatin Co.) | 100 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 2 was thus prepared.

Preparation of Recording Medium 3

Recording Medium 3 was prepared in the same manner as aforesaid Recording medium 1, except that Ink absorbing layer Coating Composition 1 was replaced with Ink absorbing layer Composition 3, described below.

Preparation of Ink absorbing layer Coating Composition 3

| | |
|---|---|
| Lime treated gelatin (KV-3000, manufactured by Konica Gelatin Co.) | 50 weight parts |
| Hydroxyethyl cellulose | 50 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 3 was thus prepared.

Preparation of Recording Medium 4

Recording Medium 4 was prepared in the same manner as aforesaid Recording Medium 1, except that Ink absorbing layer Coating Composition 1 was replaced with Ink absorbing layer Composition 4 described below.

Preparation of Ink Absorbing Layer Coating Composition 4

| | |
|---|---|
| Lime treated gelatin (KV-3000, manufactured by Konica Gelatin Co.) | 90 weight parts |
| Cationic Polymer CP-1 (Sunfix 414, manufactured by Sanyo Kasei Co., Ltd.) | 10 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 4 was thus prepared.

Preparation of Recording Medium 5

Recording Medium 5 was prepared in the same manner as aforesaid Recording medium 1, except that Ink absorbing layer Coating Composition 1 was replaced with Ink absorbing layer Composition 5, described below.

Preparation of Ink Absorbing Layer Coating Composition 5

| | |
|---|---|
| Cationic Polymer CP-2 (IN194NE, manufactured by Osaka Yuki Co., Ltd.) | 15 weight parts |
| Hydroxyethyl cellulose | 75 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 5 was thus prepared.

Preparation of Recording Media 6 and 7

Recording Media 6 and 7 were prepared in the same manner as aforesaid Recording Medium 5, except that the cationic polymer was replaced with the compounds, described below.

Recording Medium 6: Cationic Polymer CP-1

Recording Medium 7: Cationic Polymer CP-3 (IN187B, manufactured by Takamatsu Yushi Co., Ltd.)

Preparation of Recording Medium 8

Recording Medium 8 was prepared in the same manner as aforesaid Recording medium 1, except that Ink absorbing layer Coating Composition 1 was replaced with Ink absorbing layer Composition 8, described below.

Preparation of Ink Absorbing Layer Coating Composition 8

| | |
|---|---|
| Lime treated gelatin (KV-3000, manufactured by Konica Gelatin Co.) | 50 weight parts |
| Cationic Polymer CP-2 | 10 weight parts |
| Hydroxymethyl cellulose | 40 weight parts |
| Organic minute particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 8 was thus prepared.

Preparation of Recording Media 9 and 10

Recording Media 9 and 10 were prepared in the same manner as aforesaid Recording Medium 8, except that the cationic polymer was replaced with the compounds described below.

Recording Medium 9: Cationic Polymer CP-1

Recording Medium 10: Cationic Polymer CP-3

Preparation of Recording Media 11 through 13

Recording Media 11 through 13 were prepared in the same manner as aforesaid Recording media 8 through 10, except that hydroxyethyl cellulose as the cellulose derivative was replaced with carboxymethyl cellulose.

<<Evaluation of Recording Media>>

Each recording medium, prepared as above, was printed employing each of the special ink of yellow (Y), magenta (M), cyan (C), blue (B), green (G), red (R), and black (B) to obtain maximum density, while employing an ink-jet printer (MJ-5000C, manufactured by Seiko Epson Corp.). Each sample was subjected to evaluation of the items described below.

<<Evaluation of Water Resistance>>

Each image printed with dye ink was immersed in pure water at 25° C. for one minute, removed and dried. Subsequently the residual density was measured. Water resistance was obtained based on the formulas described below and was evaluated based on the criteria described below.

Water resistance (percent)=(reflection density of the immersed sample/reflection density of the non-immersed sample)×100

A: Water resistance (percent)≧95%

B: 95%>Water resistance (percent)≧80%

C: 80%>Water resistance (percent)≧60%

D: 60%>Water resistance (percent)

<Evaluation of Ink Absorbability>

A cyan solid image was printed onto each sample prepared as above, employing an ink-jet printer (MJ-5000C, manufactured by Seiko Epson Corp.), while varying the ejection amount of cyan ink. Subsequently, ink absorbability (ink flooding) was evaluated based on the method described below.

A: mottled uneven density was not noticed over the entire ink ejection range

B: slight mottled uneven density was noticed in the greater ink ejection, however resulting in no problems for commercial viability C: mottled uneven density was noticed in the greater ink ejection range, while resulting in the commercial viability range D: mottled uneven density was noticed over the entire ink ejection range, resulting in quality problems for commercial viability <Evaluation of Glossiness>

The surface glossiness of a non-printed portion and a black ink printed portion was visually observed, and the glossiness was evaluated based on the criteria described below.

A: excellent glossiness was exhibited prior to and after printing, resulting in no problems for commercial viability B: sufficient glossiness was exhibited prior to and after printing, resulting in no problems for commercial viability C: glossiness differed prior to and after printing, resulting in no problems for commercial viability D: glossiness between prior to and after printing degraded, resulting in non commercial viability Table 1 shows the evaluation results.

TABLE 1

| Recording | Constitution of Ink Receiving Layer | | | | Evaluation Result | | |
|---|---|---|---|---|---|---|---|
| Medium No. | Gelatin | Cellulose Class | Cationic Polymer | Anionic Polymer | Water Resistance | Ink Absorbabilty | Glossiness |
| 1 | — | hydroxyethyl cellulose | — | — | D | C | D |
| 2 | presence | — | — | — | D | C | B |

TABLE 1-continued

| Recording | Constitution of Ink Receiving Layer | | | | Evaluation Result | | |
|---|---|---|---|---|---|---|---|
| Medium No. | Gelatin | Cellulose Class | Cationic Polymer | Anionic Polymer | Water Resistance | Ink Absorbabilty | Glossiness |
| 3 | presence | hydroxyethyl cellulose | — | — | D | A | A |
| 4 | presence | — | CP-1 | — | C | D | C |
| 5 | — | hydroxyethyl cellulose | CP-2 | — | B | C | D |
| 6 | — | hydroxyethyl cellulose | CP-1 | — | B | C | D |
| 7 | — | hydroxyethyl cellulose | CP-3 | — | B | C | D |
| 8 | presence | hydroxyethyl cellulose | CP-2 | — | B | B | A |
| 9 | presence | hydroxyethyl cellulose | CP-1 | — | B | B | B |
| 10 | presence | hydroxyethyl cellulose | CP-3 | — | B | B | B |
| 11 | presence | carboxymethyl cellulose | CP-2 | — | A | A | A |
| 12 | presence | carboxymethyl cellulose | CP-1 | — | A | A | A |
| 13 | presence | carboxymethyl cellulose | CP-3 | — | A | A | A |

As can clearly be seen from Table 1, recording media having an ink absorbing layer comprising a cationic polymer as well as a cellulose derivative exhibited excellent water resistance, ink absorbability, and glossiness. It is also found that the aforesaid effects were exhibited more by employing carboxymethyl cellulose which is cellulose having a carboxylic acid group.

Example 2

<<Preparation of Recording Media>>

Recording Media 21 through 30 were prepared according to the steps described below.

Preparation of Recording Medium 21

Recording Medium 21 was prepared by carrying out simultaneous multilayer coating of the layers described below onto Support 1 prepared in Example 1, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 7.0 g/m$^2$ |
| Polyvinylpyrrolidone K-90 (manufactured by BASF) | 3.0 g/m$^2$ |
| (Third Layer: Uppermost Layer) | |
| Lime treated gelatin (KV-3000, manufactured by Konica Gelatin Co.) | 1.0 g/m$^2$ |
| Polyvinylpyrrolidone K-90 (manufactured by BASF) | 0.4 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

Preparation of Recording Medium 22

Recording Medium 22 was prepared by carrying out simultaneous multilayer coating of the layers described below onto Support 1 prepared in Example 1, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 7.0 g/m$^2$ |
| Polyvinylpyrrolidone K-90 (manufactured by BASF) | 2.0 g/m$^2$ |
| Cationic Polymer CP-1 (mentioned above, having an ink adsorption ratio of 75 percent) | 1.0 g/m$^2$ |
| (Third Layer: Uppermost Layer) | |
| Lime treated gelatin (KV-3000, manufactured by Konica Gelatin Co.) | 1.0 g/m$^2$ |
| Cationic Polymer CP-2 (mentioned above, having an ink adsorption ratio of 94 percent) | 0.5 g/m$^2$ |
| Organic minute particle matting agent (MR-13G, manufactured by Soken Kagaku Co.) | 60 mg/m$^2$ |
| Surfactant (Megafacs F-120) | 26 mg/m$^2$ |

Preparation of Recording Medium 23

Recording Medium 23 was prepared by carrying out simultaneous multilayer coating of the layers described below onto Support 1 prepared in Example 1, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 7.0 g/m$^2$ |
| Polyvinylpyrrolidone K-90 (manufactured by BASF) | 2.0 g/m$^2$ |
| Cationic Polymer CP-1 (having an ink adsorption ratio of 75 percent) | 0.5 g/m$^2$ |
| Cationic Polymer CP-2 (having an ink adsorption ratio of 94 percent) | 0.5 g/m$^2$ |

-continued

| (Third Layer: Uppermost Layer) | |
|---|---|
| Lime treated gelatin (KV-3000, manufactured by Konica Gelatin Co.) | 1.0 g/m$^2$ |
| Polyvinylpyrrolidone K-90 (manufactured by BASF) | 0.4 g/m$^2$ |
| Organic minute particle matting agent (MR-13G, manufactured by Soken Kagaku Co.) | 60 mg/m$^2$ |
| Surfactant (Megafacs F-120) | 26 mg/m$^2$ |

Preparation of Recording Medium 24

Recording Medium 24 was prepared by carrying out simultaneous multilayer coating of the layers described below onto Support 1 prepared in Example 1, employing a curtain coater.

| (First Layer: Lowermost Layer) | |
|---|---|
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 7.0 g/m$^2$ |
| Polyvinylpyrrolidone K-90 (manufactured by BASF) | 2.0 g/m$^2$ |
| Cationic Polymer CP-2 (having an ink adsorption ratio of 94 percent) | 1.0 g/m$^2$ |
| (Third Layer: Uppermost Layer) | |
| Lime treated gelatin (KV-3000, manufactured by Konica Gelatin Co.) | 1.0 g/m$^2$ |
| Cationic Polymer CP-1 (having an ink adsorption ratio of 75 percent) | 0.5 g/m$^2$ |
| Organic minute particle matting agent (MR-13G, manufactured by Soken Kagaku Co.) | 60 mg/m$^2$ |
| Surfactant (Megafacs F-120) | 26 mg/m$^2$ |

Preparation of Recording Medium 25

Recording Medium 25 was prepared in the same manner as aforesaid Recording Medium 22, except that the constitution of the second layer was varied as described below.

| (Second Layer) | |
|---|---|
| Lime treated gelatin (KV-3000, manufactured by Konica Gelatin Co.) | 3.5 g/m$^2$ |
| Carboxymethyl cellulose (abbreviated as CMC in Table 2) | 3.5 g/m$^2$ |
| Polyvinylpyrrolidone K-90 (manufactured by BASF) | 2.0 g/m$^2$ |
| Cationic Polymer CP-1 (having an ink adsorption ratio of 75 percent) | 1.0 g/m$^2$ |

Preparation of Recording Medium 26

Recording Medium 26 was prepared in the same manner as aforesaid Recording Medium 24, except that the constitution of the third layer was varied as described below.

| (Third Layer: Uppermost Layer) | |
|---|---|
| Lime treated gelatin (KV-3000, manufactured by Konica Gelatin Co.) | 0.5 g/m$^2$ |
| Carboxymethyl cellulose | 0.5 g/m$^2$ |
| Cationic Polymer CP-1 (having an ink adsorption ratio of 75 percent) | 0.5 g/m$^2$ |
| Organic minute particle matting agent (MR-13G, manufactured by Soken Kagaku Co.) | 60 mg/m$^2$ |
| Surfactant (Megafacs F-120) | 26 mg/m$^2$ |

Preparation of Recording Medium 27

Recording Medium 27 was prepared in the same manner as aforesaid Recording Medium 24, except that the constitution of the second layer was varied as described below.

| (Second Layer) | |
|---|---|
| Lime treated gelatin (KV-3000, manufactured by Konica Gelatin Co.) | 3.5 g/m$^2$ |
| Carboxymethyl cellulose (abbreviated as CMC in Table 2) | 3.5 g/m$^2$ |
| Polyvinylpyrrolidone K-90 (manufactured by BASF) | 2.0 g/m$^2$ |
| Cationic Polymer CP-2 (having an ink adsorption ratio of 94 percent) | 1.0 g/m$^2$ |

Preparation of Recording Medium 28

Recording Medium 28 was prepared in the same manner as aforesaid Recording Medium 27, except that the cationic polymer of the second and third layers was varied as described below.

| | |
|---|---|
| Second Layer: | Cationic Polymer CP-3 (previously described, having an ink adsorption ratio of 89 percent) |
| Third Layer: | Cationic Polymer CP-4 (Polyment NK-100PM, having an ink adsorption ratio of 81 percent, manufactured by Nippon Shokubai Co., Ltd.) |

Recording Medium 29

Recording Medium 29 was prepared in the same manner as aforesaid Recording Medium 27, except that the constitution of the second layer was varied as described below.

| (Second Layer) | |
|---|---|
| Lime treated gelatin (KV-3000, manufactured by Konica Gelatin Co.) | 3.5 g/m$^2$ |
| Carboxymethyl cellulose | 3.5 g/m$^2$ |
| Polyvinyl alcohol (PVA235, manufactured by Kuraray Kogyo Co., Ltd., in Table 2, abbreviated as PVA) | 2.5 g/m$^2$ |
| Cationic Polymer CP-2 (having an ink adsorption ratio of 94 percent) | 0.5 g/m$^2$ |

Recording medium 30

Recording Medium 30 was prepared in the same manner as aforesaid Recording Medium 27, except that the constitution of the third layer was varied as described below.

| (Third Layer: Uppermost Layer) | |
|---|---|
| Lime treated gelatin (KV-3000, manufactured by Konica Gelatin Co.) | 0.5 g/m$^2$ |
| Polyvinyl alcohol (PVA235, manufactured by Kuraray Kogyo Co., Ltd.) | 0.5 g/m$^2$ |
| Cationic Polymer CP-1 (having an ink adsorption ratio of 75 percent) | 0.5 g/m$^2$ |
| Organic minute particle matting agent (MR-13G, manufactured by Soken Kagaku Co.) | 60 mg/m$^2$ |
| Surfactant (Megafacs F-120) | 26 mg/m$^2$ |

The ink adsorption ratio of each cationic polymer employed to prepare the aforesaid sample is a value obtained by the aforesaid method while using black dye ink.

Recording mediums 27-a, 27-b, 27-c and 27-d were prepared by changing the amount of lime treated gelatin ((KV-3000, manufactured by Konica Gelatin Co.) in the Second Layer used for preparing the aforementioned Recording Medium 27 as follows; 4.5, 4.3, 2.7 and 2.0 g/m$^2$, and also by changing the amount of the Cationic Polymer CP-1 (ink absorptivity ratio=94%) in the Second Layer used for preparing the aforementioned Recording Medium 27 as follows; 0.05, 0.15, 1.8 and 2.5 g/m$^2$ for 27-a, 27-b, 27-c and 27-d respectively.

Each content ratio of the cationic polymer in the Second Layer which contains carboxymethyl cellulose and a cationic polymer is; 10, 0.5, 1.5, 18 and 25 weight % for 27, 27-a, 27-b, 27-c and 27-d respectively. These values are based on the total weight of the Second Layer.

Recording mediums 28-a, 28-b, 28-c and 28-d were prepared by substituting carboxymethyl cellulose in the Second Layer used for preparing the aforementioned Recording Medium 28 with an equal amount of hydroxyethyl cellulose, hydroxypropyl cellulose, methyl cellulose and lime treated gelatin, respectively.

<<Evaluation of Recording Media>>

After printing images employing the same method described in Example 1, water resistance, ink absorbability and glossiness were evaluated according to the methods described in Example 1. Further, discoloration resistance was also evaluated employing the method described below.

Evaluation of Discoloration Resistance

Cyan dye ink was charged into an ink-jet printer (MJ-5000C, manufactured by Seiko Epson Corp.), and cyan solid images were printed on each recording medium prepared as above to result in a density of approximately 1.0. Subsequently, discoloration resistance was evaluated employing the method described below.

Each solid image portion, which had been printed employing the aforesaid method, was posted near an interior office window for 6 months so as to be exposed to an ambient air flow but to be not exposed to direct sun light. The reflection density of the printed portion prior to and after posting was measured employing red monochromatic light and a residual density ratio was obtained based on the following formula. Subsequently, discoloration resistance was evaluated based on the criteria described below.

Residual density ratio=(density after 6-month posting/density prior to posting)×100 (percent)

A: Residual density ratio≧95%
B: 95%>Residual density ratio≧85%
C: 85%>Residual density ratio≧75%
D: 75%>Residual density ratio Table 2 shows the results obtained above.

TABLE 2

| Recording Medium | Second Layer | | | | Third Layer | | | | Evaluation Result | | | | |
|---|---|---|---|---|---|---|---|---|---|---|---|---|---|
| | Cationic Polymer | | | | Cationic Polymer | | | | | | | | |
| No. | Type | *1 | Cellulose | PVA | Type | *1 | Cellulose | PVA | Water Resistance | Ink Absorbability | Dis-Coloration Resistance | Glossiness | Remarks |
| 21 | — | — | — | — | — | — | — | — | D | C | D | A | Comp. |
| 22 | CP-1 | 75 | — | — | CP-2 | 94 | — | — | B | C | C | C | Com. |
| 23 | CP-2<br>CP-1 | 94<br>75 | — | — | — | — | — | — | B | C | C | B | Com. |
| 24 | CP-2 | 94 | — | — | CP-1 | 75 | — | — | B | B | B | A | Inv. |
| 25 | CP-1 | 75 | CMC | — | CP-2 | 94 | — | — | C | B | C | B | Com. |
| 26 | CP-2 | 94 | — | — | CP-1 | 75 | CMC | — | C | A | B | C | Inv. |
| 27 | CP-2 | 94 | CMC | — | CP-1 | 75 | — | — | A | A | B | A | Inv. |
| 28 | CP-3 | 89 | CMC | — | CP-4 | 81 | — | — | A | A | B | B | Inv. |
| 29 | CP-2 | 94 | CMC | Yes | CP-1 | 75 | — | — | A | A | A | C | Inv. |
| 30 | CP-2 | 94 | CMC | — | CP-1 | 75 | — | Yes | A | A | A | B | Inv. |
| 27-a | CP-2 | 94 | CMC | — | CP-1 | 75 | — | — | D | A | A | A | Inv. |
| 27-b | CP-2 | 94 | CMC | — | CP-1 | 75 | — | — | C | A | A | A | Inv. |
| 27-c | CP-2 | 94 | CMC | — | CP-1 | 75 | — | — | A | B | B | C | Inv. |
| 27-d | CP-2 | 94 | CMC | — | CP-1 | 75 | — | — | A | C | C | D | Inv. |
| 28-a | CP-3 | 89 | *2 | — | CP-4 | 81 | — | — | B | B | B | C | Inv. |
| 28-b | CP-3 | 89 | *3 | — | CP-4 | 81 | — | — | C | B | B | C | Inv. |
| 28-c | CP-3 | 89 | *4 | — | CP-4 | 81 | — | — | B | A | C | B | Inv. |
| 28-d | CP-3 | 89 | — | — | CP-4 | 81 | — | — | B | C | B | B | Inv. |

*1; Ink Adsorption Ratio,
*2; Hydroxyethyl cellulose,
*3; Hydroxypropyl cellulose,
*4; Methyl cellulose
Comp.; Comparative Example
Inv.; Present Invention As can clearly be seen from Table 2, the recording media of the present invention employing cationic polymers having a large ink adsorption ratio in the lower layer exhibited excellent water resistance of ink, ink absorbability, and discoloration resistance compared to the comparative example.

Further, in the aforesaid constitution, by adding a cellulose derivative and polyvinyl alcohol to the ink absorbing layer in which cationic polymers having a large ink adsorption ratio existed, it was possible to obtain excellent printing characteristics.

Example 3

<<Preparation of Recording Media>>

Recording Media 1A through 13A were prepared according to the steps described below.

Preparation of Recording Medium 1A

Preparation of Support 1A

A 35 μm thick low density polyethylene with a density of 0.92 was applied onto the reverse surface of a 200 g/m$^2$ basic weight photographic base paper, with a water content of 6 percent, employing an extrusion coating method. Subsequently, a 40 μm thick low density polyethylene with a density of 0.92, comprising 5.5 percent of anatase type titanium oxide, was applied onto the front surface, employing an extrusion coating method, whereby Support 1A covered with polyethylene on both sides was prepared. The front surface was then subjected to corona discharge and was coated with a sublayer comprised of polyvinyl alcohol at a coating weight of 0.03 g/m$^2$. The reverse surface was also subjected to corona discharge followed by application of a latex layer at a coating weight of 0.12 g/m$^2$.

Preparation of Ink Absorbing Layer Coating Composition 1A

| | |
|---|---|
| Lime treated gelatin (KV-3000, manufactured by Konica Gelatin Co.) | 50 weight parts |
| Polyvinyl alcohol (PVA235, manufactured by Kuraray Kogyo Co., Ltd.) | 50 weight parts |
| Minute organic particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Ink absorbing layer Coating Composition 1A was thus prepared.

Coating

The aforesaid Ink absorbing layer Coating Composition 1A was applied onto Support 1A prepared as above at a dried layer weight of 8 g/m$^2$, employing a bar coating method. The coating was temporarily cooled to approximately 7° C., and then dried by 20 to 65° C. blown air, whereby Recording Medium 1A was prepared.

The pH of the layer surface of Recording Medium 1A, prepared as above, was determined in accordance with the method specified in Paper Pulp Test Method No. 49–86, in such a manner that approximately 50 μl of pure water was dripped onto the surface of the recording medium and the pH was measured with a flat electrode brought into contact with the water drops. The resulting pH was 4.5.

Preparation of Recording Medium 2A

Recording Medium 2A was prepared in the same way as aforesaid Recording Medium 1A, except that Ink absorbing layer Coating Composition 1A was replaced with Ink absorbing layer Coating Composition 2A, described below.

Preparation of Ink Absorbing Layer Coating Composition 2A

| | |
|---|---|
| Lime treated gelatin (KV-3000, manufactured by Konica Gelatin Co.) | 50 weight parts |
| Polyvinyl alcohol (PVA235, manufactured by Kuraray Co., Ltd.) | 45 weight parts |
| Cationic polymer PAA-HCl (polyacrylamine hydrochloric acid salt, manufactured by Nitto Boseki Co., Ltd.) | 5 weight parts |
| Minute organic particle matting agent (MR-13G, manufactured by Soken Kagaku Co.) | 0.5 weight part |
| Surfactant (Megafacs F-120) | 0.3 weight part |

The aforesaid additives were successively mixed and the resulting mixture was diluted with water so that the solid concentration of the coating composition reached 8 percent by weight. Thus Ink absorbing layer Coating Composition 2A was prepared.

The pH of the layer surface of Recording Medium 2A was 4.5.

Preparation of Recording Media 3A Through 5A

Recording Media 3A through 5A were prepared in the same way as aforesaid Recording Medium 2A, except that cationic polymer PAA-HCl employed in Ink absorbing layer Coating Composition 2A was replaced with each of the cationic polymers described below.

| | |
|---|---|
| Recording Medium 3A: | PAS-H (polydimethylallylammonium chloride manufactured by Nitto Boseki Co., Ltd.) |
| Recording Medium 4A: | Gosenol CM-318 (cation modified polyvinyl alcohol, manufactured by Nihon Gosei Kagaku) |
| Recording Medium 5A: | CP-1 |

Each of the pH of the layer surface of Recording Media 3A through 5A was 4.5.

CP-1

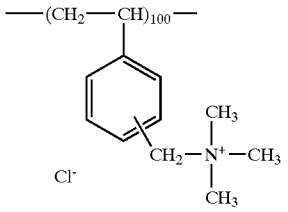

Preparation of Recording Media 6A Through 9A

Recording Media 6A through 9A were prepared in the same manner as Recording Media 2A through 5A, except that an optimum amount of citric acid was added to each of the ink absorbing layer coating compositions so that the pH of the layer surface reached 3.9.

Preparation of Recording Media 10A Through 13A

Recording Media 10A through 13A were prepared in the same manner as Recording Media 2A through 5A, except that the optimum amount of citric acid was added to each of the ink absorbing layer coating compositions so that the pH of the layer surface was to be 3.4.

PVA described in Table 3 is the abbreviated form for polyvinyl alcohol.

<<Evaluation of Recording Media>>

Each recording medium prepared as above was used for a printing test employing each of the special ink of yellow (Y), magenta (M), cyan (C), blue (B), green (G), red (R), and black (K), while employing an ink-jet printer (MJ-5000C, manufactured by Seiko Epson Co.) to achieve a maximum density of each color, and items described below were evaluated.

<Evaluation of Fixability>

Blue (B), green (G), red (R), and black (K) solid images with a maximum density were printed. A commercially available fine-quality paper sheet was placed on the printed images 1, 3, 5, and 10 minutes after printing. Subsequently, the magnitude of ink transfer onto the aforesaid fine-quality paper sheet was visually observed and fixability was evaluated based on the criteria described below.

A: slight transfer of K was noticed when a blank sheet was placed on the image 1 minute after printing, but no transfer was noticed when a blank sheet was placed on the image 3 and 5 minutes after printing, resulting in no problems for commercial viability B: slight transfer of B, G, R and K was noticed when a blank sheet was placed on the image 3 minutes after printing, but no transfer occurred when a blank sheet was placed on the image 5 and 10 minutes after printing, resulting in no problems for commercial viability C: transfer of any of B, G, R, or K was noticed when a blank sheet was placed on the image 5 minutes after printing, but no transfer was noticed when a blank sheet was placed on the image 10 minutes after printing, resulting in the lower limit for commercial viability D: transfer of any of B, G, R, or K was noticed even when a blank sheet was placed on the image 10 minutes after printing, resulting in commercial unviability <Evaluation of Glossiness>

Surface glossiness of non-printed portions and image portions printed with black ink was visually observed and glossiness was evaluated based on the criteria described below.

A: excellent glossiness was exhibited prior to and after printing, resulting in no problems for commercial viability B: sufficient glossiness was exhibited prior to and after printing, resulting no problems for commercial viability C: glossiness differed prior to and after printing, resulting in no problems of commercial viability D: glossiness between prior to and after printing degraded, Resulting in commercial unviability Table 3 shows the results of each evaluation.

TABLE 3

| Recording Medium | Ink absorbing layer | | | Evaluation Result | |
|---|---|---|---|---|---|
| No. | PVA | Cationic Polymer | Layer Surface pH | Fixability | Glossiness |
| 1A | presence | — | 4.5 | C | C |
| 2A | presence | PAA-HCl | 4.5 | A | D |
| 3A | presence | PAS-H | 4.5 | A | D |
| 4A | presence | CM-318 | 4.5 | A | D |
| 5A | presence | CP-1 | 4.5 | A | D |
| 6A | presence | PAA-HCl | 3.9 | A | B |
| 7A | presence | PAS-H | 3.9 | A | B |
| 8A | presence | CM-318 | 3.9 | A | B |
| 9A | presence | CP-1 | 3.9 | A | B |
| 10A | presence | PAA-HCl | 3.4 | B | B |
| 11A | presence | PAS-H | 3.4 | B | B |
| 12A | presence | CM-318 | 3.4 | B | B |
| 13A | presence | CP-1 | 3.4 | B | B |

As can clearly be seen from Table 3, recording media, having an ink absorbing layer comprising polyvinyl alcohol, gelatin, and cationic polymers, and in addition, exhibiting a pH of at most 4.0 on the uppermost surface, resulted in superior fixability as well as superior glossiness.

Example 4

<<Preparation of Recording Media>>

Recording Media 21A through 36A were prepared according to the steps described below.

Preparation of Recording Medium 21A

Recording Medium 21A was prepared by carrying out simultaneous multilayer coating of the layers described below onto Support 1A prepared in Example 3, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 5.0 g/m$^2$ |
| Polyvinylpyrrolidone K-90 (manufactured by BASF) | 3.0 g/m$^2$ |
| Polyurethane F-8438D (manufactured by Daiichi Kogyo Yakuhin Co.) | 2.0 g/m$^2$ |
| (Third Layer: Uppermost Layer) | |
| Lime treated gelatin (KV-3000, manufactured by Konica Gelatin Co.) | 0.5 g/m$^2$ |
| Polyvinylpyrrolidone K-90 (manufactured by BASF) | 0.4 g/m$^2$ |
| Polyurethane F-8438D (manufactured by Daiichi Kogyo Yakuhin Co.) | 0.4 g/m$^2$ |
| Minute organic particle matting agent (MR-13G, manufactured by Soken Kagaku Co.) | 60 mg/m$^2$ |
| Surfactant (Magafacs F-120) | 26 mg/m$^2$ |

Preparation of Recording Medium 22A

Recording Medium 22A was prepared by carrying out simultaneous multilayer coating of the layers described below onto Support 1A prepared in Example 3, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 5.0 g/m$^2$ |
| Polyvinylpyrrolidone K-90 (manufactured by BASF) | 2.0 g/m$^2$ |
| Polyvinyl alcohol (PVA235, manufactured by Kuraray Co., Ltd.) | 1.0 g/m$^2$ |
| Polyurethane F-8438D (manufactured by Daiichi Kogyo Yakuhin Co.) | 2.0 g/m$^2$ |
| (Third Layer: Uppermost Layer) | |
| Lime treated gelatin (KV-3000, manufactured by Konica Gelatin Co.) | 0.5 g/m$^2$ |
| Polyvinylpyrrolidone K-90 (manufactured by BASF) | 0.4 g/m$^2$ |
| Polyurethane F-8438D (manufactured by Daiichi Kogyo Yakuhin Co.) | 0.4 g/m$^2$ |

-continued

| | |
|---|---|
| Minute organic particle matting agent (MR-13G, manufactured by Soken Kagaku Co.) | 60 mg/m$^2$ |
| Surfactant (Magafacs F-120) | 26 mg/m$^2$ |

Preparation of Recording Medium 23A

Recording Medium 23A was prepared by carrying out simultaneous multilayer coating of the layers described below onto Support 1A prepared in Example 3, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 5.0 g/m$^2$ |
| Polyvinylpyrrolidone K-90 (manufactured by BASF) | 2.75 g/m$^2$ |
| Polyvinyl alcohol (PVA235, manufactured by Kuraray Co., Ltd.) | 2.00 g/m$^2$ |
| Polyurethane F-8438D (manufactured by Daiichi Kogyo Yakuhin Co.) | 2.0 g/m$^2$ |
| (Third Layer: Uppermost Layer) | |
| Lime treated gelatin (KV-3000, manufactured by Konica Gelatin Co.) | 0.5 g/m$^2$ |
| Polyvinyl alcohol (PVA235, manufactured by Kuraray Co., Ltd.) | 0.4 g/m$^2$ |
| Polyurethane F-8433D (manufactured by Daiichi Kogyo Yakuhin Co.) | 0.4 g/m$^2$ |
| Minute organic particle matting agent (MR-13G, manufactured by Soken Kagaku Co.) | 60 mg/m$^2$ |
| Surfactant (Magafacs F-120) | 26 mg/m$^2$ |

Preparation of Recording Medium 24A

Recording Medium 24A was prepared by carrying out simultaneous multilayer coating of the layers described below onto Support 1A prepared in Example 3, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 5.0 g/m$^2$ |
| Polyvinylpyrrolidone K-90 (manufactured by BASF) | 3.0 g/m$^2$ |
| Polyurethane F-8438D (manufactured by Daiichi Kogyo Yakuhin Co.) | 2.0 g/m$^2$ |
| Polyethylene glycol 20000 (manufactured by Merck Co.) | 1.0 g/m$^2$ |
| (Third Layer: Uppermost Layer) | |
| Lime treated gelatin (KV-3000, manufactured by Konica Gelatin Co.) | 0.5 g/m$^2$ |
| Polyvinyl alcohol (PVA235, manufactured by Kuraray Co., Ltd.) | 1.2 g/m$^2$ |

-continued

| | |
|---|---|
| Minute organic particle matting agent (MR-13G, manufactured by Soken Kagaku Co.) | 60 mg/m$^2$ |
| Surfactant (Magafacs F-120) | 26 mg/m$^2$ |

Preparation of Recording Medium 25A

Recording Medium 25A was prepared in the same manner as aforesaid Recording Medium 24A, except that CP-1 was added to the third layer as a cationic polymer at a coverage of 0.4 g/m$^2$.

Preparation of Recording Medium 26A

Recording Medium 26A was prepared in the same manner as aforesaid Recording Medium 23A, except that CP-1 was added to the third layer as a cationic polymer to obtain a coverage of 0.4 g/m$^2$.

<<Evaluation of Recording Media>>

Two types of the cyan ink described below, which were different in solvent concentration, were loaded in an ink-jet printer (MJ-5000C, manufactured by Seiko Epson Corporation). Subsequently, solid cyan images were printed onto each recording medium prepared as above, while varying the ejection amount of the ink, and ink absorbability (ink flooding) was evaluated employing the method described below.

Preparation of Cyan Ink

| | |
|---|---|
| (Cyan Ink 1) | |
| Light Green SF yellowish | 6 weight parts |
| Diethylene glycol | 47 weight parts |
| Water | 47 weight parts |
| (Cyan Ink 2) | |
| Light Green SF yellowish | 6 weight parts |
| Diethylene glycol | 23.5 weight parts |
| Water | 70.5 weight parts |

Evaluation of Ink Absorbability

A: mottled uneven density was not noticed over the entire ink ejection range

B: mottled uneven density was slightly noticed in the greater ink ejection range, however resulting in no problems for commercial viability C: mottled uneven density was noticed in the greater ink ejection range, while being in the commercially viable range D: mottled uneven density was noticed in the entire ink ejection range, resulting in quality problems for commercial viability Table 4 shows the results.

TABLE 4

| Recording Medium No. | Second Layer PVA (g/m$^2$) | Third Layer PVA (g/m$^2$) | Cationic Polymer in 3$^{rd}$ layer | Ink Absorbability Cyan Ink 1 | Ink Absorbability Cyan Ink 2 |
|---|---|---|---|---|---|
| 21A | — | — | absent | D | D |
| 22A | 1.0 | — | absent | C | B |
| 23A | 2.00 | 0.4 | absent | B | A |
| 24A | — | 1.2 | absent | B | B |
| 25A | — | 1.2 | present | B | B |
| 26A | 2.00 | 0.4 | present | A | A |

As can clearly be seen from Table 4, recording media in which the content ratio of polyvinyl alcohols in the ink absorbing layer as the third layer (being the uppermost layer), which was constituted according to the present invention, was more than that of the second layer, exhibited excellent ink absorbability compared to the comparative examples, even though an ink, having higher solvent ratio, was used and the mottled density unevenness was minimal.

*By changing the pH value of the above-prepared Recording medium 25A with citric acid, Recording Media 25A-a, 25A-b and 25A-c were prepared. The pH value of each are respectivly; 4.4, 3.9 and 3.6.

Similarly, by changing the pH value of the above-prepared Recording medium 26A with citric acid, Recording Media 26A-a, 26A-b and 26A-c were prepared. The pH value of each are respectivly; 4.4, 3.9 and 3.6.

These Recording Media were evaluated in the same way as Example 3. Fixability and Glossiness were evaluated and the results are listed in Table 4B.

The Recording Media of the present invention are shown to achieve improvement in Glossiness with keeping Fixability if ink within an acceptable level when the surface pH is adjusted under 4.0.

TABLE 4B

| Recording Medium No. | Second Layer PVA ($g/m^2$) | Third Layer PVA ($g/m^2$) | Cationic Polymer CP-1 in 3rd Layer | Surface PH value | Evaluation results Fixability | Evaluation results Glossiness |
|---|---|---|---|---|---|---|
| 25A-a | — | 1.2 | present | 4.4 | A | C |
| 25A-b | — | 1.2 | present | 3.9 | B | B |
| 25A-c | — | 1.2 | present | 3.6 | B | B |
| 26A-a | 2.00 | 0.4 | present | 4.4 | A | B |
| 26A-b | 2.00 | 0.4 | present | 3.9 | B | A |
| 26A-c | 2.00 | 0.4 | present | 3.6 | C | A |

Example 5

<<Preparation of Recording Media 31A Through 38A>>

Recording Media 31A through 38A were prepared in the same manner as Recording Media 24A and 25A prepared in Example 4, except that polyvinyl alcohol (PVA235) employed in the third layer was replaced with each of the polyvinyl alcohols described in Table 5, which differed in the saponification ratio and the weight average molecular weight.

<<Evaluation of Recording Media>>

Two types of the cyan ink described in Example 4, which differed in solvent concentration, were loaded in an ink-jet printer (MJ-5000C, manufactured by Seiko Epson Corporation). Subsequently, ink absorbability of each recording medium, prepared as above, was evaluated employing the method described in Example 4. At the same time, transferability was also evaluated according to the method described below. Table 5 shows the results.

Evaluation of Ink Transfer Resistance

Each recording medium was printed employing Cyan Ink 1 under maximum ejection conditions, while employing the aforesaid ink-jet printer. Thereafter, the printed recording medium was stored for 30 minutes at 23° C. and 65 percent relative humidity. The resulting recording medium was stacked to 200 fine-quality paper sheets and was allowed to stand for a whole day and night. Thereafter, ink transfer resistance was evaluated based on the criteria described below.

A: no transfer was noticed

B: slight traces of dye transfer remained, but the image itself resulted minimal change C: large traces of transfer were noticed and the image surface exhibited a cloudy state D: the ink absorbing layer significantly adhered to the piled paper sheet, making it difficult to completely peel the sheets from each other Table 5 shows the evaluation results of each item.

TABLE 5

| Recording Medium No. | Third Layer: Polyvinyl Alcohol 1 *1 | Third Layer: Polyvinyl Alcohol 1 *2 | Third Layer: Polyvinyl Alcohol 1 Added Amount ($g/m^2$) | Third Layer: Polyvinyl Alcohol 2 *1 | Third Layer: Polyvinyl Alcohol 2 *2 | Third Layer: Polyvinyl Alcohol 2 Added Amount ($g/m^2$) | Cationic Polymer | Evaluation Result: Ink Absorbability Cyan Ink 1 | Evaluation Result: Ink Absorbability Cyan Ink 2 | Evaluation Result: Ink Transfer resistance |
|---|---|---|---|---|---|---|---|---|---|---|
| 31A | — | — | — | 94 | 500 | 1.2 | absence | C | C | C |
| 32A | 90 | 2500 | 0.06 | 94 | 500 | 1.14 | absence | C | C | C |
| 33A | 90 | 2500 | 0.18 | 94 | 500 | 1.02 | absence | B | B | B |
| 34A | 90 | 2500 | 0.60 | 94 | 500 | 0.60 | absence | B | B | B |
| 35A | 88 | 2500 | 0.60 | 94 | 500 | 0.60 | absence | A | A | B |
| 36A | 89 | 4500 | 0.60 | 94 | 500 | 0.60 | absence | A | A | A |
| 37A | 90 | 4500 | 0.84 | 89 | 3500 | 0.36 | absence | A | A | A |
| 38A | 90 | 4500 | 0.84 | 89 | 3500 | 0.36 | presence | A | A | A |

*1; Saponification Ratio

*2; Weight Average Molecular Weight

As can clearly be seen from Table 5, recording media in which polyvinyl alcohol, which had a saponification ratio of at most 92 percent and a weight average molecular weight of at least 2,000, was employed in the third layer in an amount of at least 10 percent by weight with respect to the total polyvinyl alcohol in the aforesaid medium, exhibited excellent ink absorbability as well as excellent ink transfer resistance.

Example 6

<<Preparation of Recording Media>>

Recording Media 41A through 45A were prepared according to the steps described below.

Preparation of Recording Medium 41A

Recording Medium 41A was prepared by carrying out simultaneous multilayer coating of the layers described below onto Support 1A prepared in Example 3, employing a curtain coater.

| | |
|---|---|
| (First Layer: Lowermost Layer) | |
| Lime treated gelatin (KV-3000, manufactured by Konica Gelatin Co.) | 1.2 g/m$^2$ |
| Polyvinylpyrrolidone K-90 (manufactured by BASF) | 0.8 g/m$^2$ |
| (Second Layer) | |
| Lime treated gelatin (KV-3000, manufactured by Konica Gelatin Co.) | 5.0 g/m$^2$ |
| Polyvinylpyrrolidone K-90 (manufactured by BASF) | 3.0 g/m$^2$ |
| Polyurethane F-8438D (manufactured by Daiichi Kogyo Yakuhin Co.) | 2.0 g/m$^2$ |
| Polyethylene glycol 20000 (manufactured by Merck Corp.) | 1.0 g/m$^2$ |
| (Third Layer: Uppermost Layer) | |
| Lime treated gelatin (KV-3000, manufactured by Konica Gelatin Co.) | 1.7 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

Preparation of Recording Medium 42A

Recording Medium 42A was prepared in the same manner as Recording Medium 41A, except that the constitution of the third layer was changed as described below.

| | |
|---|---|
| (Third Layer: Uppermost Layer) | |
| Lime treated gelatin (KV-3000, manufactured by Konica Gelatin Co.) | 1.0 g/m$^2$ |
| Carboxymethyl cellulose | 0.7 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

Preparation of Recording Medium 43A

Recording Medium 43A was prepared in the same manner as Recording Medium 41A, except that the constitution of the third layer was changed as described below.

| | |
|---|---|
| (Third Layer: Uppermost Layer) | |
| Lime treated gelatin (KV-3000, manufactured by Konica Gelatin Co.) | 1.0 g/m$^2$ |
| Polyvinyl alcohol (PVA235, manufactured by Kuraray Co., Ltd.) | 0.7 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

Preparation of Recording Medium 44A

Recording Medium 44A was prepared in the same manner as Recording Medium 41A, except that the constitution of the third layer was changed as described below.

| | |
|---|---|
| (Third Layer: Uppermost Layer) | |
| Lime treated gelatin (KV-3000, manufactured by Konica Gelatin Co.) | 0.5 g/m$^2$ |
| Polyvinyl alcohol (PVA235, manufactured by Kuraray Co., Ltd.) | 0.7 g/m$^2$ |
| Carboxymethyl cellulose | 0.5 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

Preparation of Recording Medium 45A

Recording Medium 45A was prepared in the same manner as Recording Medium 41A, except that the constitution of the third layer was changed as described below.

| | |
|---|---|
| (Third Layer: Uppermost Layer) | |
| Lime treated gelatin (KV-3000, manufactured by Konica Gelatin Co.) | 0.5 g/m$^2$ |
| Polyvinyl alcohol (PVA235, manufactured by Kuraray Co., Ltd.) | 0.7 g/m$^2$ |
| Carboxymethyl cellulose | 0.5 g/m$^2$ |
| CP-1 | 0.1 g/m$^2$ |
| Organic minute particle matting agent (MR-13G, manufactured by Soken Kagaku Co.) | 60 mg/m$^2$ |
| Surfactant (Magafacs F-120) | 26 mg/m$^2$ |

<<Evaluation of Recording Media>>

Cyan Ink 1, described in Example 4, was loaded in an ink-jet printer (MJ-5000C, manufactured by Seiko Epson Corporation). Subsequently, solid cyan images were printed onto each recording medium prepared as above under an ambience of 16° C. and 30 percent relative humidity as well as at 30° C. and 70 percent relative humidity, while varying the ink ejection amount. Then, ink absorbability (ink flooding) was evaluated according to the method described in Example 4. Table 6 shows the results.

TABLE 6

| Recording Medium No. | Constitution of Third Layer: PVA Derivative | Cellulose derivative | Cationic Polymer | Ink Absorbability: 16° C. and 30% RH | 30° C. and 70% RH |
|---|---|---|---|---|---|
| 41A | — | — | — | D | C |
| 42A | — | presence | — | C | B |
| 43A | presence | — | — | B | C |
| 44A | presence | presence | — | A | A |
| 45A | presence | presence | CP-1 | A | A |

Based on Table 6, it can be confirmed that recording media comprising the polyvinyl alcohol derivative as well as the cellulose or derivatives thereof in the same layer always exhibited consistent ink absorbability even though ambience during printing was altered.

Example 7

<<Preparation of Recording Media>>

Recording Media 51A through 59A were prepared in the same manner as Recording Medium 21A of Example 4, except that the amount of the lime treated gelatin in the third layer was changed to 3.0 g/m$^2$, and polyvinyl alcohol (PVA235, manufactured by Kuraray Co., Ltd.), cationic polymer (PAS-H) and cationic polymer (CP-1) were added to the second layer and the third layer in the combinations described in Table 5. In the layer to which polyvinyl alcohol was added, the added amount of polyvinylpyrrolidone was decreased corresponding to the aforesaid added amount.

<<Evaluation of Recording Media>>

Cyan Ink 1, described in Example 4, was loaded in an ink-jet printer (MJ-5000C, manufactured by Seiko Epson Corporation). Subsequently, solid cyan images were printed onto each recording medium prepared, as above, to obtain a cyan density of approximately 1. Subsequently, discoloration resistance was evaluated, employing the method described below. Table 7 shows the results.

Evaluation of Discoloration Resistance

Each solid image portion, which had been printed employing the aforesaid method, was posted next to an interior window in an office room for 6 months so as to be exposed to an ambient air flow but not to direct sun light. The reflection density of the printed portion prior to and after posting was measured employing red monochromatic light and a residual density ratio was obtained based on the following formula. Subsequently, discoloration resistance was evaluated based on the criteria described below.

Residual density ratio=(density after 6-month posting/density prior to posting)×100 (percent)

A: Residual density ratio≧95%
B: 95%>Residual density ratio≧85%
C: 85%>Residual density ratio≧75%
D: 75%>Residual density ratio

TABLE 7

| Recording Medium No. | Constitution of Second Layer: Added Amount of PVA (g/m$^2$) | Cationic Polymer Added: Type | Added Amount (g/m$^2$) | Constitution of Third Layer: Added Amount of PVA (g/m$^2$) | Cationic Polymer: Type | Added Amount (g/m$^2$) | Discoloration Resistance |
|---|---|---|---|---|---|---|---|
| 51A | — | — | — | — | — | — | D |
| 52A | 0.25 | — | — | — | PAS-H | 0.4 | C |
| 53A | — | PAS-H | 0.2 | 1.2 | PAS-H | 0.6 | A |
| 54A | 0.25 | PAS-H | 0.2 | — | PAS-H | 0.6 | B |
| 55A | — | PAS-H | 0.2 | — | PAS-H | 0.6 | D |
| 56A | 0.25 | — | — | — | CP-1 | 0.6 | C |
| 57A | — | CP-1 | 0.2 | 1.2 | CP-1 | 0.6 | A |
| 58A | 0.25 | CP-1 | 0.2 | — | CP-1 | 0.6 | B |
| 59A | — | CP-1 | 0.2 | — | CP-1 | 0.6 | D |

As can clearly be seen from Tale 7, recording materials of the present invention, in which two ink absorbing layer comprised the cationic polymer and the ink absorbing layer which comprised the cationic polymer in the largest amount comprised the polyvinyl alcohol derivative, exhibited excellent discoloration resistance against oxidizing gases.

The present invention is capable of providing a swelling type ink-jet recording medium which exhibits excellent ink fixability, ink absorbability, glossiness, and discoloration resistance.

What is claimed is:

1. An ink-jet recording sheet comprising a support having thereon in the following order:

(i) a first ink absorbing layer comprising gelatin and a first cationic polymer; and (ii) a second ink absorbing layer comprising gelatin and a second cationic polymer, wherein the first cationic polymer has a larger ink adsorption ratio $A_i$ than the second cationic polymer, the ink adsorption ratio $A_i$ being defined by the following equation:

$A_i$ (%)=((an optical density of a print after immersion in water)/(an optical density of a print before immersion in water))×100.

2. The ink-jet recording sheet of claim 1, wherein at least one of the first ink absorbing layer and the second ink absorbing layer comprises a cellulose derivative.

3. The ink-jet recording sheet of claim 1, wherein the first ink absorbing layer comprises a cellulose derivative.

4. The ink-jet recording sheet of claim 3, wherein at least one of the first ink absorbing layer and the second ink absorbing layer comprises a polyvinyl alcohol.

5. The ink-jet recording sheet of claim 2, wherein the cellulose derivative comprises a carboxyl group in the molecule.

6. The ink-jet recording sheet of claim 3, wherein the cellulose derivative comprises a carboxyl group in the molecule.

7. The ink-jet recording sheet of claim 2, wherein the cellulose derivative is selected from the group consisting of carboxymethyl cellulose, methyl cellulose, hydroxypropyl cellulose and hydroxyethyl cellulose.

8. The ink-jet recording sheet of claim 3, wherein the cellulose derivative is selected from the group consisting of carboxymethyl cellulose, methyl cellulose, hydroxypropyl cellulose and hydroxyethyl cellulose.

9. The ink-jet recording sheet of claim 2, wherein an amount of the cationic polymer in the ink absorbing layer comprising the cellulose derivative is 1 to 20 weight % based on the total weight of the absorbing layer.

10. An ink-jet recording sheet comprising a support having at least two ink absorbing layers thereon, wherein at least one of the two ink absorbing layers comprises gelatin and a polyvinyl alcohol; the ink absorbing layers comprise the polyvinyl alcohol having a saponification degree of not more than 92% and a weight-average molecular weight of not less than 2000 in an amount of not less than 10 weight % based on the total weight of the polyvinyl alcohol in all of the ink absorbing layers; the outermost ink absorbing layer has a largest weight content ratio of the polyvinyl alcohol among all of the ink absorbing layers; and the outermost ink absorbing layer comprises the polyvinyl alcohol having a saponification degree of not more than 92% and a weight-average molecular weight of not less than 2000.

11. The ink-jet recording sheet of claim 10, wherein a surface pH value of the outermost ink absorbing layer is not more than 4.0.

12. The ink-jet recording sheet of claim 10, wherein at least one of the ink absorbing layers comprises gelatin, a polyvinyl alcohol and a cellulose derivative.

13. The ink-jet recording sheet of claim 10, wherein at least one of the ink absorbing layers comprises a cationic polymer.

14. The ink-jet recording sheet of claim 10, wherein at least one of the ink absorbing layers comprises at least two kinds of cationic polymers.

15. The ink-jet recording sheet of claim 10, wherein each of the two ink absorbing layers comprises a cationic polymer, and one of the two ink absorbing layers comprising a largest weight amount of the cationic polymer comprises a polyvinyl alcohol.

16. The ink-jet recording sheet of claim 1, wherein the outermost ink absorbing layer has a largest weight content ratio of the polyvinyl alcohol among all of the ink absorbing layers, and the ink absorbing layers comprise the polyvinyl alcohol having a saponification degree of not more than 92% and a weight-average molecular weight of not less than 2000 in an amount of not less than 10 weight % based on the total weight of the polyvinyl alcohol in all of the ink absorbing layers; the outermost ink absorbing layer has a largest weight content ratio of the polyvinyl alcohol among all of the ink absorbing layers; and the outermost ink absorbing layer comprises the polyvinyl alcohol having a saponification degree of not more than 92% and a weight-average molecular weight of not less than 2000.

* * * * *